US005686118A

United States Patent [19]

Kurata

[11] Patent Number: 5,686,118

[45] Date of Patent: Nov. 11, 1997

[54] APPARATUS FOR COMPRESSING-FORMING POWDER

[75] Inventor: Masanori Kurata, Mie-ken, Japan

[73] Assignee: TRIS Inc., Japan

[21] Appl. No.: 499,511

[22] Filed: Jul. 7, 1995

[51] Int. Cl.[6] ..... B30B 11/04; B28B 3/08

[52] U.S. Cl. ..... 425/122; 425/126.1; 425/344; 425/345

[58] Field of Search ..... 425/122, 126.1, 425/345, 344, 353, 354

[56] References Cited

U.S. PATENT DOCUMENTS

| | | | |
|---|---|---|---|
| 3,677,673 | 7/1972 | Shapiro | 425/345 |
| 3,999,922 | 12/1976 | Shimada | 425/345 |
| 4,057,381 | 11/1977 | Korsch | 425/345 |
| 4,383,810 | 5/1983 | Bunn et al. | 425/122 |
| 4,475,880 | 10/1984 | Crossley et al. | 425/345 |

*Primary Examiner*—James P. Mackey
*Attorney, Agent, or Firm*—Suzuye & Suzuye

[57] ABSTRACT

An apparatus has an apparatus body and a support shaft rotatably supported on the apparatus body. An intermediate plate is provided at an intermediate height of the apparatus body with a plurality of dies arranged in a substantially parallel plane where corresponding forming chambers are defined. Relative to those areas corresponding to the forming chambers, upper punches are provided above the intermediate plate in a way to be movable in an up/down direction and lower punches are provided below the intermediate plate in a way to be movable in the up/down direction. The upper punch is held in a raised position in a given timing corresponding to the rotation of the main shaft at which time powder is fed into the forming chamber. When the upper punch is released from being held in a raised position, the upper punch is downwardly driven to allow it to enter into the forming chamber. The lower punch is held in that lowered position where the lower end opening is closed. The lower punch is pushed upwardly in synchronization with the lowering of the upper punch and enters into the forming chamber so that the powder in the forming chamber is compression-formed in cooperation with the upper punch.

11 Claims, 6 Drawing Sheets

APPARATUS FOR COMPRESSING-FORMING POWDER

BACKGROUND OF THE INVENTION

1. Field of the Invention

The present invention relates to an apparatus for compression-forming powder which is fed into forming chambers of dies.

2. Description of the Related Art

In the manufacture of slide brushes for motors etc., powder carbon, a material for the brushes, is compression-formed. A cam type apparatus is known as such an apparatus for the manufacture of products above.

The conventional cam type powder compression-forming apparatus is constructed as follows: That is, the apparatus body has a fixed die having a forming chamber. An upper punch is provided above the die and slidable in an up/down direction while, on the other hand, a lower punch is provided below the lower die and slidable in the up/down direction.

The upper punch is driven by a rotationally driven upper cam to be pushed in a downward direction while, on the other hand, the lower punch is similarly driven by a lower cam to be pushed in an upward direction. The paired punches, upper and lower, are given an up/down reciprocatory movement in synchronization with a 360° rotation of the upper and lower cams. With the upper punch lowered and the lower punch raised, the powder filled in the forming chamber is compression-formed by the paired punches.

In the formation of a product by a compression-forming apparatus, three steps are required: a step for feeding the powder into a die chamber, a step for compression-forming the powder into a product and a step of knocking out the product from the die chamber. In order to form one product, the three steps are required, thus prominently lowering its productivity involved.

For an improved production to be achieved, it may be considered that the time required be reduced in these production steps. It is not easy, however, to reduce the time necessary to the feeding of the powder and picking-up of a product formed. It may be possible to reduce the time involved by speed up the rotation of the cams during the compression-forming of the product. However, it is not possible to achieve the high rotation speed of the cams so as to enable the coordination of those times involved at the pre- and post-formation of the product as well as to suppress noise to a low level. Difficulty is also encountered to enhance such productivity by speeding up the rotation speed of the cams.

In order to achieve improved productivity, a plurality of compression-forming apparatus have to be installed, thus incurring high costs in equipment.

For the conventional cam type compression-forming apparatus it has not been possible to achieve improved productivity because a single product has been formed at a time through one rotation of the paired cams.

SUMMARY OF THE INVENTION

It is accordingly the object of the present invention to provide an apparatus for compression-forming powder into products in a larger quantity production than a conventional cam type compression-forming apparatus.

According to one preferred embodiment of the present invention, there is provided an apparatus for compression-forming powder into products, comprising:

an apparatus body;

a main shaft having an axis along an up/down direction of the apparatus body and rotatably supported on the apparatus body;

drive means for rotationally driving the main shaft;

an intermediate plate provided at an intermediate height of the apparatus body in a substantially horizontal state and having a plurality of dies arranged at predetermined intervals along a circumferential direction of the main shaft with a corresponding number of forming chambers opened at upper and lower ends and supplied with the powder;

a plurality of upper punches provided in those positions corresponding to the forming chambers on the upper surface side of the intermediate plate and slidable along the up/down direction;

a plurality of lower punches provided in those positions corresponding to the forming chambers on a lower surface side of the intermediate plate and slidable along the up/down direction;

upper holding means for holding the upper punches in the upper raised positions of the dies in a predetermined timing in accordance with a rotation of the main shaft;

powder feeding means for feeding the powder into the forming chambers when the upper punches are held by the upper holding means in the raised positions;

lower holding means for non-slidably holding the lower punches in lower positions lower than those positions where the lower end openings of the forming chambers are closed;

upper pressure applying means for downwardly pushing the upper punches into the forming chambers when the holding of the upper punches by the upper holding means in the raised positions is released in accordance with the rotation of the main shaft; and lower pressure applying means for, when the upper punches are downwardly pushed by the upper pressure applying means in accordance with the rotation of the main shaft, upwardly pushing the lower punches from the lower positions into the forming chambers in synchronization with the corresponding timing.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention and, together with the general description given above and the detailed description of the preferred embodiment given below, serve to explain the principles of the invention.

DETAILED DESCRIPTION OF THE PREFERRED EMBODIMENT

The embodiment of the present invention will be explained below with reference to the accompanying drawings.

Figure 1:
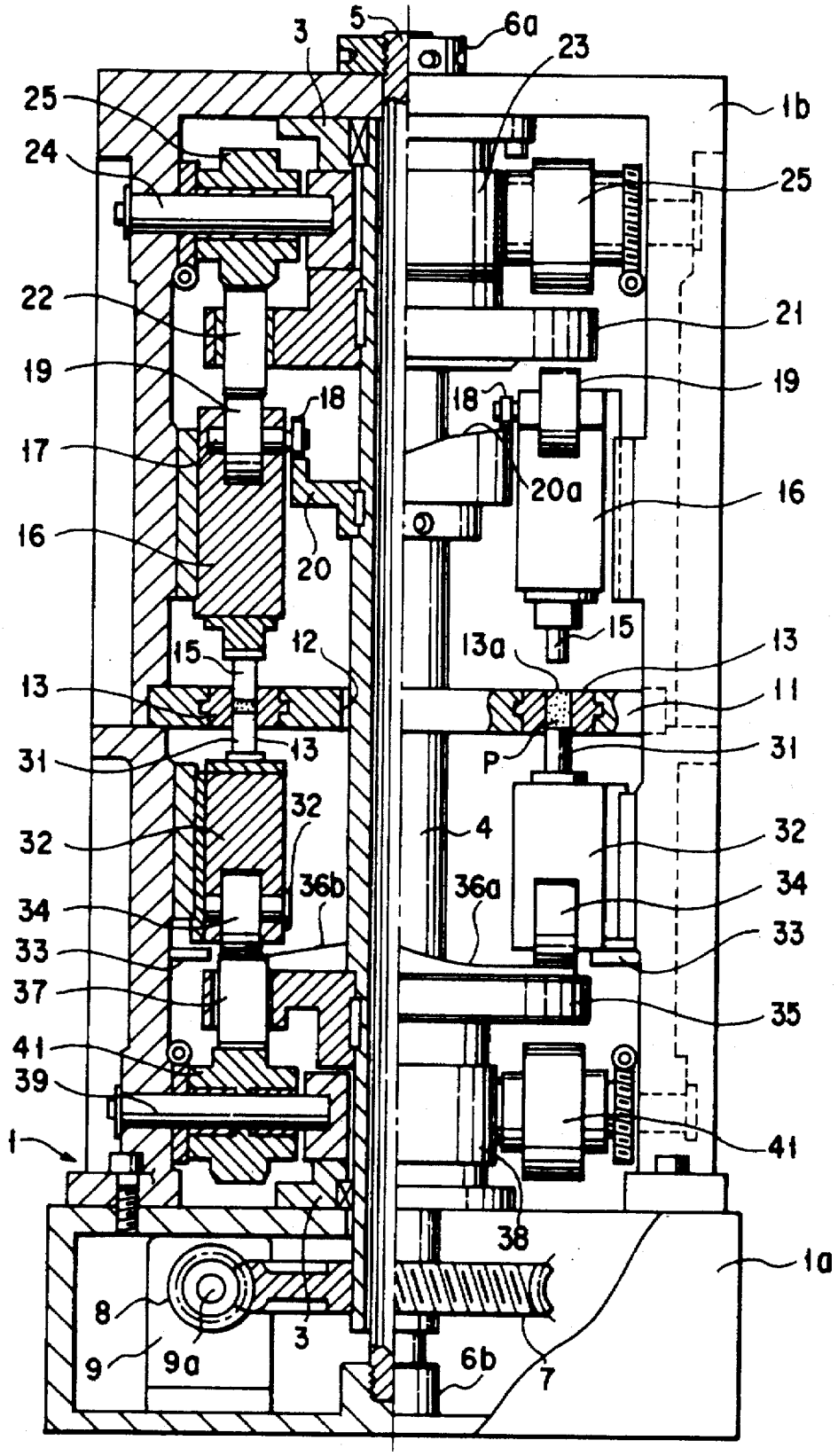
FIG. 1 is a front view, partly in cross-section, generally showing an apparatus according to an embodiment of the present invention.

The drawings shows one embodiment of the present invention and FIG. 1 shows a powder compression-forming apparatus including an apparatus body 1. The apparatus body 1 comprises a rectangular box-like base la and a frame section 1*b* provided upright on the upper surface of the base 1*a*. Radial bearings 3 are provided one at the central area of the upper surface plate of the base 1*a* of the body 1 and one at the central area of the inner surface of the upper end plate of the frame 1*b*. A hollow main shaft 4 is rotatably supported, by these radial bearings 3, at the upper and lower end sides. A support shaft 5 is inserted through the main shaft 4.

The upper end portion of the support shaft 5 is projected from the upper surface of the frame section 1*b* with the projected end area fixedly threaded in an upper nut 6*a* and the lower end portion of the support shaft is fixedly threaded in a lower nut 6*b* provided on the inner bottom surface of the base 1*a*. By doing so, the apparatus body 1 is so constructed as to have its upward/downward rigidity improved by the support shaft 5.

The main shaft 4 extends through the radial bearing 3 into the base la with a worm wheel 7 fitted on its lower end area. A worm 8 is threaded on the worm wheel 7. The worm 8 is fitted over a shaft 9*a* of a drive source 9. When the worm 8 is rotated by the drive shaft 9*a* of the drive source 9, the main shaft 4 is rotated through the worm wheel 7.

Figure 2:
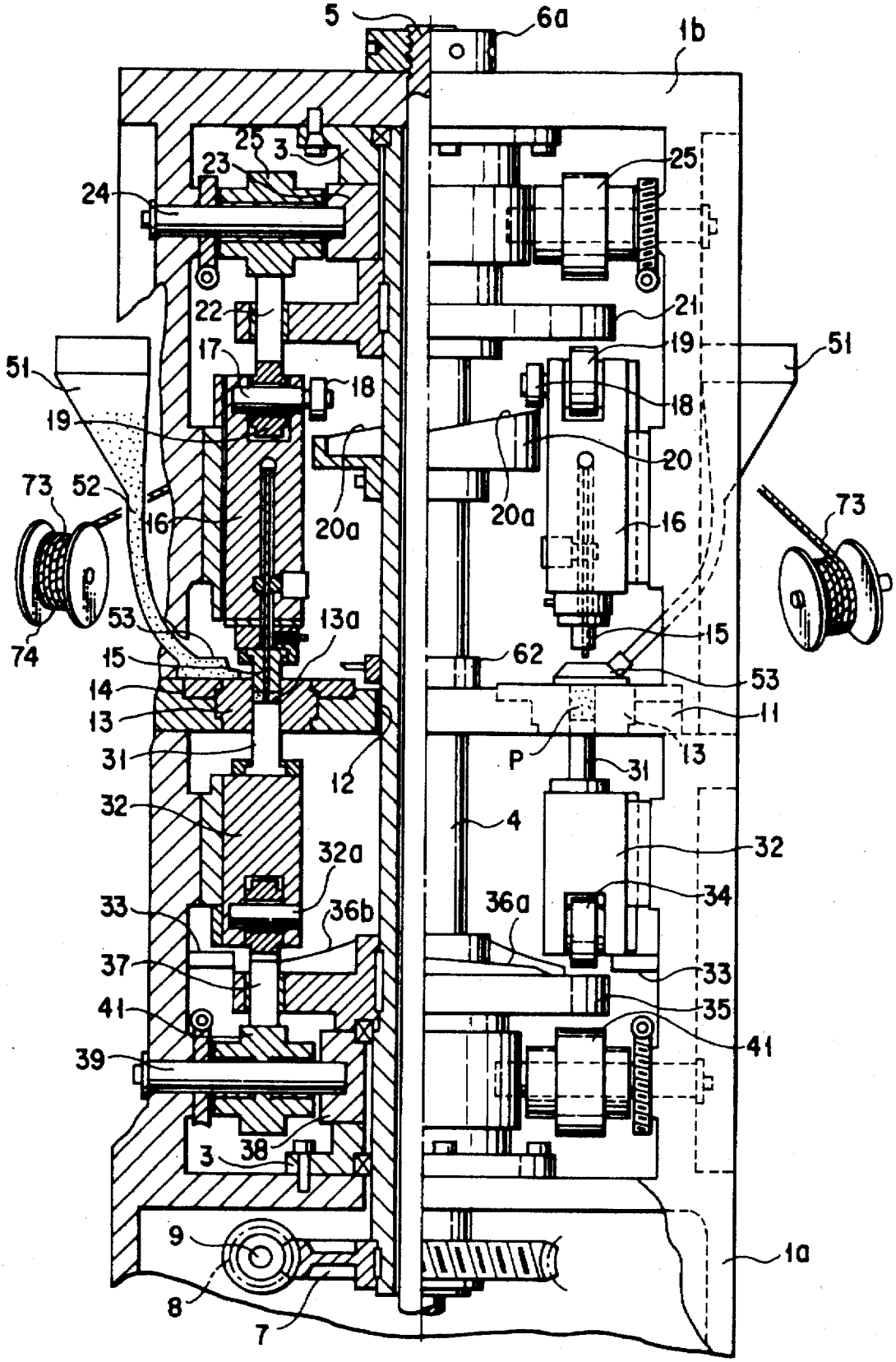
FIG. 2 is an enlarged view, partly broken away, showing compression-forming sections in FIG. 1.
Figure 3:
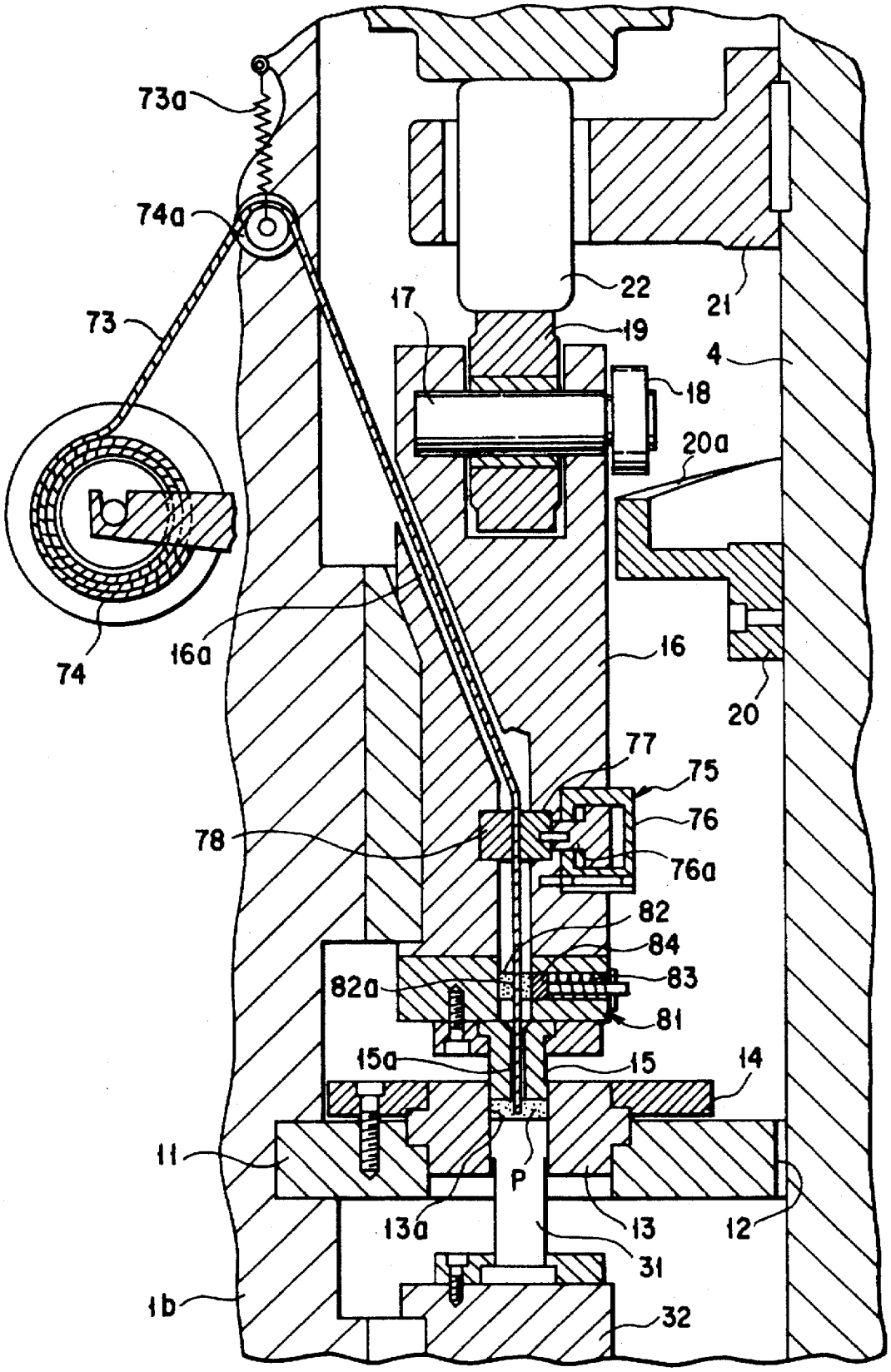
FIG. 3 is an enlarged view, partly taken away, showing an upper ram section in FIG. 1.
Figure 4:
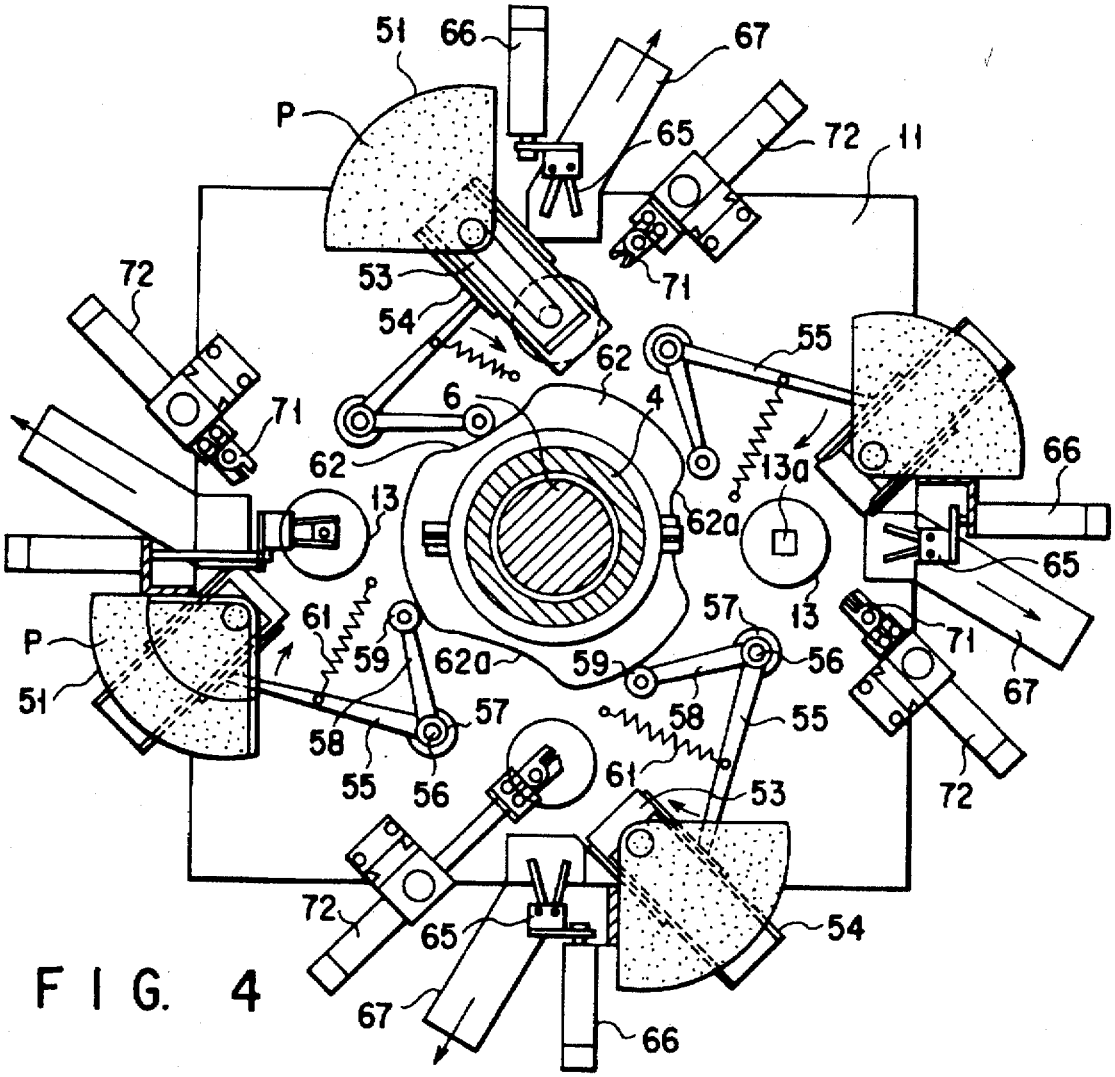
FIG. 4 is a cross-sectional view showing a top side of an intermediate section in FIG. 1.

An intermediate plate 11 is horizontally provided at an intermediate position of the frame section 1*b* of the apparatus body 1. A through hole 12 is provided at the central area of the intermediate plate 11 to allow the main shaft 4 to be inserted there. Four dies 13 are located around the through hole 12 in predetermined intervals, for example, in 90° intervals in the present embodiment as shown in FIG. 4. The respective dies 13 are fixedly retained by die plates 14, respectively, as shown in FIG. 2. A forming chamber 13*a* rectangular in cross-section extends through the die 13 in its thickness direction.

An upper punch 15 is arranged above the upper surface side of the intermediate plate 11 at an area corresponding to the die 13. A punch 15 is held at the lower end face of a prismatic upper ram 16 slidable along the inner surface of the frame section 1*b* in an up/down direction. An upper ram shaft 17 is provided at the upper side of the upper ram 16 with one end portion of the upper ram shaft 17 extending to the inner side surface of the upper ram 16. A cam follower 18 is rotatably provided on one projecting end area of the upper ram shaft 17 and an upper ram roll 19 is rotatably fitted over the intermediate portion of the upper ram shaft 17 with a portion of the upper ram roll 19 projected from the upper end face of the upper ram 16.

The cam follower 18 provided relative to the upper ram 16 is so set as to be put in rolling contact with a cam face 20*a* of an upper cam body 20. The cam body 20 is mounted on the main shaft 4 above the intermediate plate 11. That is, three cam faces 20*a* comprised of an arc-like wall are circumferentially formed at about 120° intervals on the upper cam body 20. When, relative to the four upper rams 16, three cam followers 18 take a top dead point of the cam face 20 or an intermediate position between the top and a bottom dead point, that is, when these cam followers are held in a raised position, then the cam follower 18 of the remaining one ram 16 takes the bottom dead point. As a result, one upper ram 16 with the cam follower 18 is placed in a lowered state.

The upper punch 15 on the lower end face of the upper ram 16 in the lowered state has its lower end portion enter into the forming chamber 13*a* of the die 13.

An upper rotation plate 21 is integrally provided on the upper portion of the main shaft 4 at an area above the upper cam body 20. Three shaft-like upper pressure applying members 22 (only one is shown) are circumferentially provided at 120° intervals on the upper rotation plate 21 such that these members are slidable in an up/down direction and that they are retained against a downward withdrawal, for example, retained by a spring means, not shown. The three upper pressure applying members 22 are arranged in the circumferential direction of the upper rotation plate 21 in a position to correspond to the bottom dead point of the two cam faces 20*a* of the cam body 20.

The three upper pressure applying members 22 are rotated together with the upper rotation plate 21 when the main shaft 4 is rotated. In a predetermined rotation position, the upper pressure applying member 22 applies pressure to the upper ram roll 19 of the upper ram 16 in the lowered state as will set out below.

Figure 5:
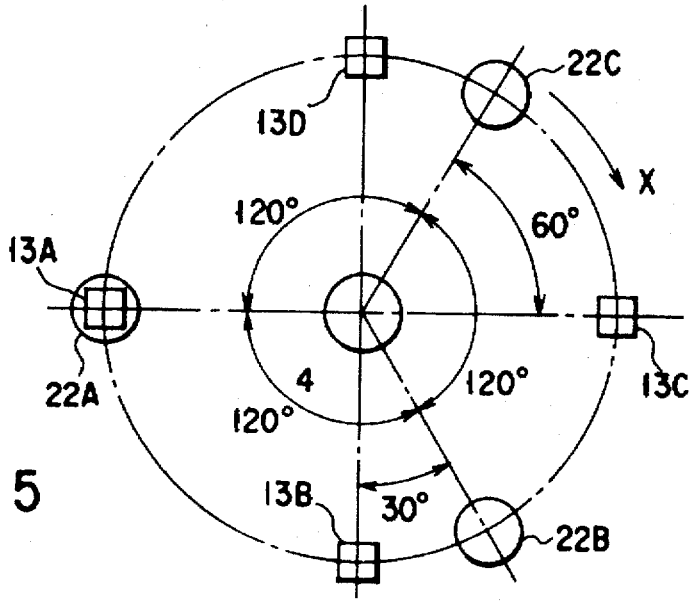
FIG. 5 is an explanatory view showing a positional relation of upper pressure applying members on an upper rotation plate to dies provided at the intermediate rotation plate.

As shown in FIG. 5, the four dies 13 (upper rams 16) are circumferentially provided at 90° intervals at the intermediate plate 11 and the three upper pressure applying members 22 are provided at 120° intervals in the upper pressure applying member 21. As will be seen FIG. 5, with the three pressure applying members 22 represented by 22A, 22B and 22C, respectively, and the four dies 13 represented by 13A, 13B, 13C and 13D, respectively, when one upper pressure applying member 22A takes a position opposite one die position 13A, then the pressure applying member 22B situated one position previous to the die 13A as viewed in a counterclockwise direction is located to a position 30° previous to the die 13B and the pressure applying member 22C situated two positions previous to the die 13A is located to a position 60° previous to the die 13C.

Therefore, each time the upper rotation plate 21 is rotated through 30° in a clockwise direction as indicated by an arrow X in FIG. 5, the three pressure applying members 22A, . . . , 22C are sequentially positioned opposite the four dies 13A, . . . , 13D and press against the corresponding upper rams 16 and, with the 360° rotation of the upper rotation plate 21, the four upper rams 16 are so pressed three times, that is, one upper ram 16 is so pressed, by three pressure applying members 22A, 22B and 22C, three times.

Above the upper rotation plate 21, an upper support 23 is rotatably mounted on the main shaft 4 as shown in FIGS. 1 and 2. Four support shafts 24 have their one-end sides mounted circumferentially around the upper support 23 in 90° intervals in those positions corresponding to the four upper rams 16. The other-end sides of the respective support shafts 24 are mounted in the side wall of the frame section 1*b* of the apparatus body 1. The respective support shafts 24 are so provided as to make their axes extend in a horizontal direction.

An upper back-up roll 25 is rotatably supported on the respective support shaft 24. The respective upper back-up roll 25 is located opposite to the upper ram roll 19 provided on the upper end side of the upper ram 16. With the rotation of the upper rotation plate 21, the pressure applying member 22 enters between the upper ram roll 19 on the upper ram 16 and the upper back-up roll 25. By doing so, the pressure applying member 22 is pressed downwardly by the upper back-up roll 25.

With the pressure applying member 22 so pressed, the upper ram roll 19 is pressed by the pressure applying member. At this time, the upper ram 16 with the upper ram roll 19 provided thereon releases a retained state at the top dead point attained by the cam face 20*a* of the upper cam 20.

With the upper ram roll 19 so pressed, the upper ram 16 is moved in slide motion to allow the upper punch 15 on the lower end face of the upper ram 16 to enter into the forming chamber 13*a* of the die 13.

A lower punch 31 is provided on the lower surface side of the intermediate plate 11 in a position corresponding to the die 13. A lower punch 31 is mounted on the upper end face of a prismatic lower ram 32 slidable along an up/down direction relative to the inner surface of the frame section 1*b*. The lower ram 32 has its lowering position restricted by a stopper 33 provided on the inner surface of the frame section 1*b*.

That is, as shown on the right side in FIG. 2, the lower ram 32 has its lower end face abutted against the stopper 33 such that it enters to a small extent into the lower portion of the forming chamber 13*a* of the die 13 with the bottom opening of the forming chamber 13*a* closed, so that the lower punch 31 is retained against further lowering. This is in a ready state of the lower punch 31.

With the lower punch 31 in a ready state and the upper punch 15 in a raised state, powder P, such as powdered carbon, is supplied into the forming chamber 13*a* by a powder supplying means as will be set out below. When the lower punch 31 is lowered from a raised position to the ready position in the forming chamber 13*a*, the powder P is sucked by a suction force created in the forming chamber 13*a* by that lowering movement.

The position of the stopper 33 is adjustable in an up/down direction by a drive means not shown. By doing so, the extent to which the lower punch 31 enters into the forming chamber 13*a* can be varied, thus enabling an amount of powder P which is fed into the forming chamber 13*a* to be controlled.

A lower ram shaft 32*a* is mounted on the lower end portion of the lower ram 32 and a lower ram roll 34 is rotatably mounted on the lower ram shaft 32*a* with a portion of a lower roll 34 projected from the lower end face of the lower ram 32. Below the lower ram 32 a lower rotation plate 35 is provided integral with the main shaft 4. On the upper surface of the lower rotation plate 35 three powder feeding cams 36*a* and push-out cams 36*b* of arc walls as shown in FIG. 2 are circumferentially provided in predetermined ranges. Since the lower ram 32 is lowered along an inclined surface of the powder supply cam 36*a* after being raised by the push-out cam 36*b*, the powder P is sucked into the forming chamber 13*a* of the die 13 as already set out above.

Three lower pressure applying members 37 (only one is shown in FIG. 2) are circumferentially provided at 120° intervals on the lower rotation plate 35 and are slidable in the up/down direction without being downwardly withdrawn out of the lower rotation plate 35. Below the lower rotation plate 35 a lower support 38 is rotatably fitted on the main shaft 4. Four support shafts 39 have their one-end sides horizontally coupled at 90° intervals around the lower support 38. The other-end sides of the support shafts are mounted in the frame section 1*b*. A lower back-up roll 41 is rotatably mounted over the support shaft 39.

The lower pressure applying member 37 is so set as to correspond to the circumferential position of the upper pressure applying member 22 in the upper rotation plate 21. When the upper punch 15 is downwardly pressed by the upper pressure applying member 22, the lower punch 31 is upwardly pressed by the lower pressure applying member 37 through the lower ram 32. That is, the upper and lower punches 15 and 31 are pushed relative to each other in an interlocking relation. As a result, the powder P filled in the forming chamber 13*a* in the die 13 is compression-formed by the paired punches 15, 31.

Figure 7A:
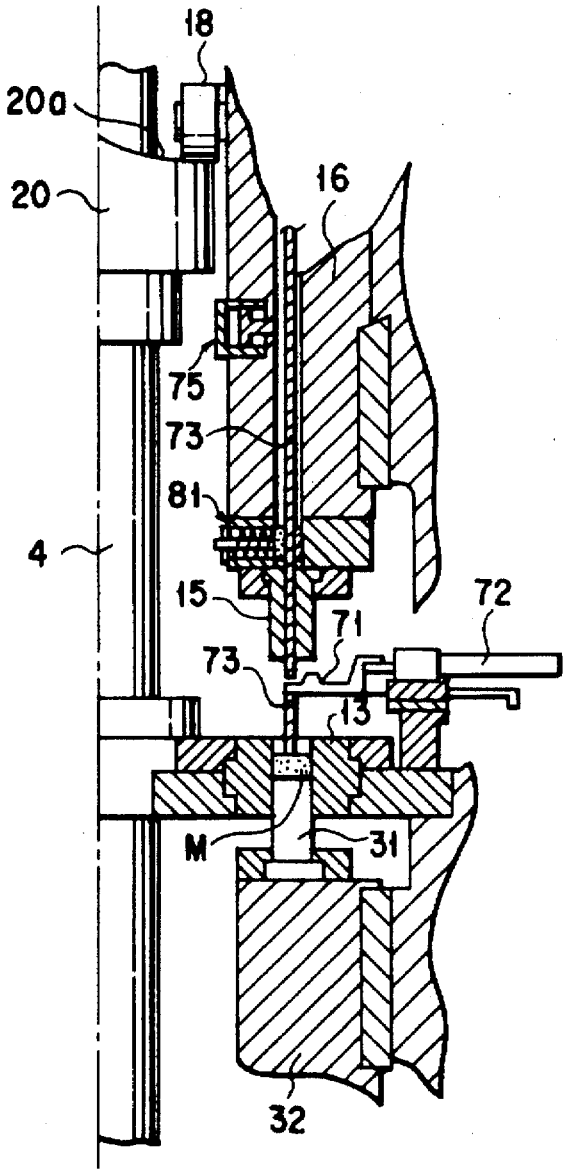
FIG. 7A is an explanatory view showing a lead wire cutting step of the manufacturing process of the formed product.
Figure 7B:
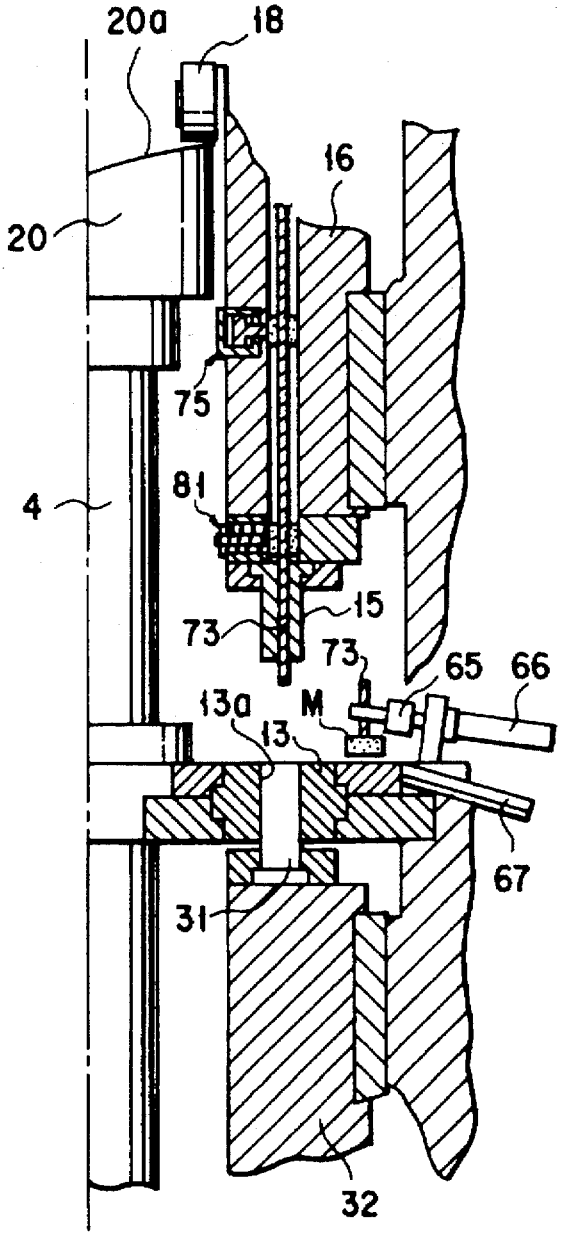
FIG. 7B is an explanatory view showing a product picking-up step of the manufacturing step.

The lower ram 32 (lower punch 31) is upwardly pushed by the lower pressure applying member 37 to allow the powder P to be compression-formed relative to the upper punch 15 and, thereafter, is further pushed upwardly by the push-out cam 36*a*. At this time, the upper punch 15 is upwardly pushed by the cam face 20*a* of the upper cam body 20. By doing so, the compression-molded compact mass, that is, a shaped product as shown in FIGS. 7A and 7B, in the forming chamber 13*a* is ejected by the lower punch 31 from the forming chamber 13*a*.

That is, with the rotation of the main shaft 4, the feeding of the powder P, compression-forming of it and ejecting of a resultant shaped product M are sequentially carried out at the forming chambers 13*a* of four dies 13 on the intermediate plate 11. That is, with the main shaft 4 rotated in a 360° rotation process, three products per each die 13, hence 12 products M per four dies 13 in total, can be manufactured on the present apparatus.

As shown in FIGS. 2 and 4, the powder feeding means has hoppers 51 arranged above the four dies 13 to feed the powder P to the forming chambers. A flexible tube 52 is connected at one end to the lower end of the hopper 51. The other end of the tube 52 is connected to the feeder 53. The feeder 53 is so provided as to be slidable along a guide 54 on the upper surface of the intermediate plate 11. The guide 4 is so located as to have its forward end oriented toward the corresponding die 13.

One end of a first arm 55 is pivotally attached to the feeder 54. The other end of the first arm 55 is connected to a cylinder 57. The cylinder 57 is rotatably fitted over a support shaft 56 extending from the intermediate member. On end of a second arm 58 is connected to the cylinder 57. A cam follower 59 is rotatably provided on the other end of the second arm 58. The first arm 55 is urged by a spring 61 in a direction as indicated by an arrow in FIG. 4. By this arrangement, the cam follower 59 is brought into pressure contact with a feeding cam 62 mounted integral with the main shaft 4.

Three recesses 62*a* are circumferentially provided at 120° intervals on the outer periphery of the feeding cam 62. When, with the cam rotated, the cam follower 59 is brought in pressure contact with the recess 62*a* of the cam 62, the first arm 55 is rotated, in an arrow-indicated direction, by the urging force of the spring 61, thus allowing the feeder 53 to a position where the feeder covers the upper surface of the die 13 and hence the powder P in the feeder 53 to be set in a position in which it is fed to the forming chamber 13*a*.

The recesses 62*a* of the supply cam 62 are circumferentially provided in those positions substantially corresponding to the top dead point of the cam face 20. In consequence, when the upper punch 15 is held in a raised position, the feeder 53 slides just over the forming chamber 13*a* so that the powder P is fed into the forming chamber 13*a*. That is, with one rotation of the main shaft 4, the powder P is fed three times into the forming chamber 1*a*.

On the side of the feeder 53 of the intermediate plate 11, a clamper 65 is so provided as to be movable, by a clamp cylinder 66, toward and away from the die 13 as shown in FIG. 4 so that it can clamp a product ejected upwardly from the forming chamber 13*a*. The 10 clamper 65 is closed in a forward position to clamp the product upwardly ejected out of the forming chamber 13*a*, while, on the other hand, the clamper 65 is opened in a backward position to allow the product to be delivered to a chute 67.

On the side of the clamper 65 a cutter 71 is so provided as to be movable, by a cutter cylinder 72, toward and away from the die 13. The cutter 71 is used to cut a lead wire 73 whose end is buried in the product. That is, with the end portion of the lead wire 73 inserted into the forming chamber 13*a* as will be set out below, the powder P is compression-formed in the forming chamber and, before a product is upwardly ejected by the lower punch 31, the cutter 71 is driven in the forward direction so that the lead wire portion projected from the product is cut to a predetermined length.

The lead wire 73 is coiled around a bobbin 74 which is rotatably mounted on the frame section 1*b*. The lead wire 73 is delivered from the bobbin 74 into the forming chamber 13*a* in the die 13 past a tension roller 74a elastically supported by a spring 73*a* and then past those through holes 16*a* and 15*a* respectively provided in the upper ram 16 and upper punch 15.

An air clamper 75 is provided for holding the lead wire 73 extending through the through hole 16*a* in the ram 16. The air clamper 75 has an air cylinder 76 and rod 76*a* and a movable member 77 is provided on the rod 76*a* in a manner to be exposed to the through hole 16*a*. A fixing member 78 is arranged in a position opposite the movable member 77 in the through hole 16*a* with the lead wire 73 inserted in a sandwiched relation between these members. The movable member 77 is driven toward and away from the fixing member 78 to allow the lead wire 73 to be held or released from being held.

A spring-type clamper 81 is provided below the air clamper 75 of the upper ram 16. The spring-type clamper 81 has an elastic member 82 in the through hole 16*a* and a movable member 84 compressing the elastic member 82 under a restoring force of a spring 83. The lead wire 73 is inserted through an insertion hole 82*a* in the elastic member 82. It is, therefore, possible to impart a given frictional force by the elastic member 82 to the lead wire 73 at all times so that the lead wire 73 extending from the bobbin 74 is prevented from being loosened.

The air clamper 75 releases the lead wire 73 when the upper ram 16 is raised and clamps the lead wire when it is lowered. As will be appreciated from the above, the air clamper 75 enables the lead wire 73 to be fed to a given length each time the upper ram 16 is lowered.

With reference to FIGS. 6A, 6B, 7A and 7B, an explanation will be given below of the steps of compression-forming, for example, a motor's slide brush on the powder compression apparatus thus structured.

Figure 6A:
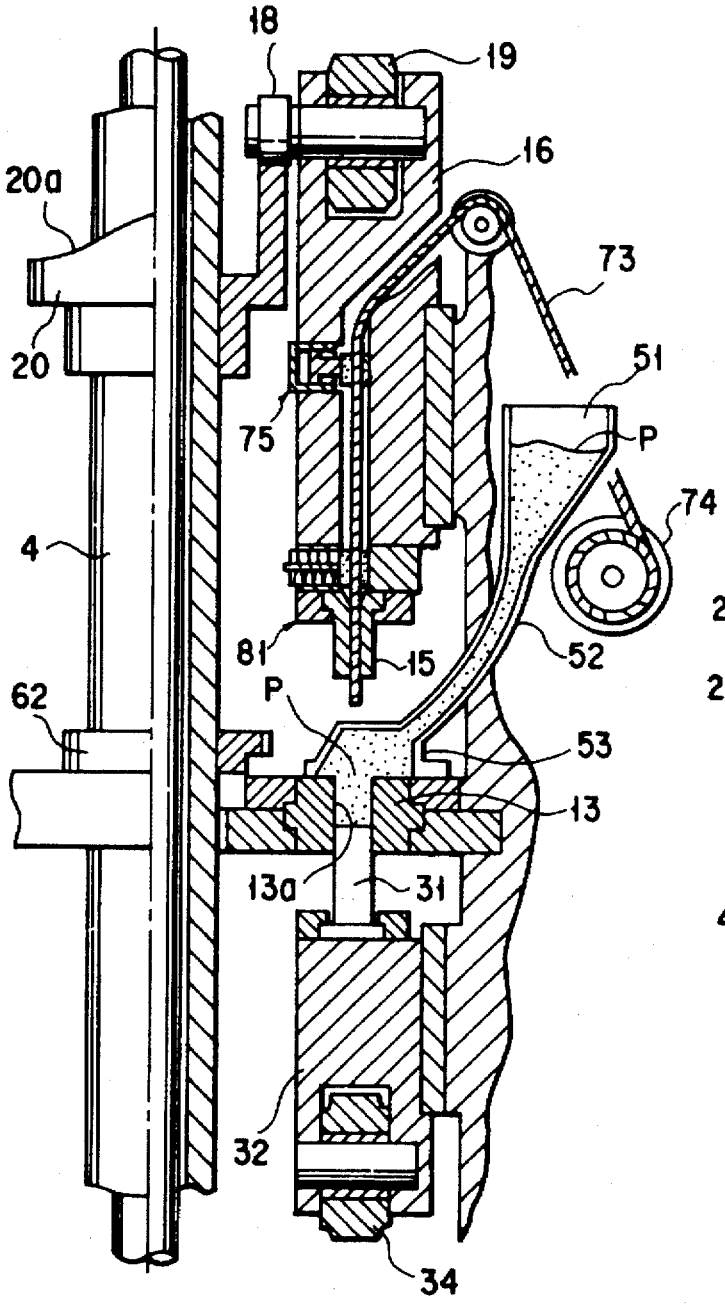
FIG. 6A is an explanatory view showing a step for feeding powder in a manufacturing process of a formed product.
Figure 6B:
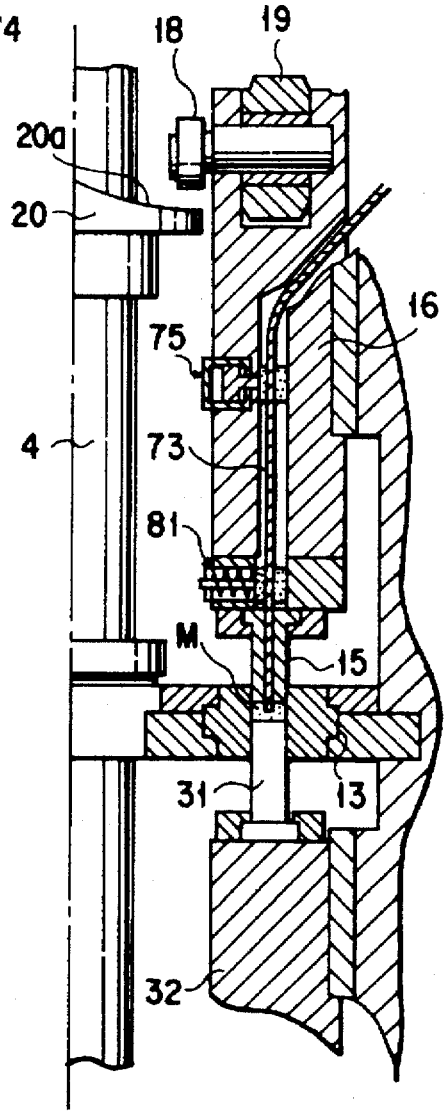
FIG. 6B is an explanatory view showing a compression-forming step of the manufacturing process of the formed product.

First, as shown in FIG. 6A, the upper punch 15, together with the upper ram 16, is held by the upper cam body 20 in a raised position and, when, with the rotation of the main shaft 4 and hence the supply cam 62, the feeder 53 is driven to the position where it covers the forming chamber 13*a* in the die 13, the lower punch 31 is lowered from its raised position to a position where the punch 31 abuts against the stopper 33. At this time, the powder P is fed under a resultant suction force into the forming chamber 13*a*.

With the powder P so fed, the feeder 53 is retracted back and the upper punch 15 is pressed downwardly through the upper back-up roll 25, upper pressure applying member 22, upper ram roll 19 and upper ram 16, while, on the other hand, the lower punch 31 is pushed upwardly through the lower back-up roll 41, lower pressure applying member 37, lower ram roll 35 and lower ram 32. By doing so, the powder P filled in the forming chamber 13*a* is compression-formed by the opposed punches 15 and 31.

When a shaped product M is obtained by the compression-forming of the powder P, the upper punch 15 is upwardly driven by the cam face 20*a* of the upper cam 20 as shown in FIG. 7A. Then the cutter 71 is driven in the forward direction and cuts, to a given length, the lead wire 73 which is projected from the shaped product M.

With the lead wire 73 so cut, the cutter 71 is retracted back and, as shown in FIG. 7B, the lower punch 31 is upwardly driven by the push-out cam face 36*a* on the lower rotation plate 35 to allow the product M to be ejected from the forming chamber 13*a*. Then the clamper 65 is driven in the forward direction to grasp the exposed lead wire portion of the product M and is retracted back, feeding the product M onto the chute 67.

Four steps in a series, that is, the powder-filling, powder compression-forming, lead wire-cutting and product-grasping step, are sequentially effected at the forming chambers 13*a* of the four dies. With the main shaft 4 rotated through an angle of 360°, three products M are compression-formed at a time at the forming chambers 13*a* of the four dies 13. That is, with the cam rotated through an angle of 360°, 12 products M can be formed, thus offering a factor-of-12 increase in productivity over the conventional cam-type compression-forming apparatus for producing one product at a time with a 360° rotation of a cam.

Further, four different forming chambers 13*a* can be provided relative to four dies 13 in the intermediate plate 11 and, in this case, four different products can be produced on one compression-forming apparatus. Products of different properties can also be produced by feeding different kinds of powder P in the respective forming chambers 13*a*.

The present invention is not restricted to the above-mentioned embodiment and can be variously changed or modified without departing from the spirit and scope of the present invention. For example, two or more dies can be provided instead of four dies only and, in this case, it is still possible to provide an improved productivity over the conventional apparatus.

Although use is made of the mechanism for holding the upper punch in a raised position with the rotation of the main shaft, such a mechanism may be so constructed that, instead of the upper cam body, a slidable upper ram is moved by an air cylinder in an upward direction and an associated positioning means, such as a stopper, is provided so that the upper ram can be positioned to a predetermined position. According to the present invention, the upper ram is operated before the lower ram is raised and, with the top side of the forming chamber closed, powder can be compression-formed in the forming chamber and it is possible to prevent the powder from being scattered around the apparatus.

Further, since, as a pressure applying mechanism, the upper-punch need only be pushed in a proper timing in accordance with the rotation of the main shaft, a cam can be provided on the upper rotation plate, instead of the upper pressure member, in which case the upper punch is pushed by the cam through the upper ram.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An apparatus for compression-forming powder into products, comprising:

an apparatus body;

a main shaft having an axis along an up/down direction of the apparatus body and rotatably supported on the apparatus body;

drive means for rotationally driving the main shaft;

an intermediate plate provided at an intermediate height of the apparatus body in a substantially horizontal state and having a plurality of dies arranged at predetermined intervals along a circumferential direction of the main shaft with a corresponding number of forming chambers opened at upper and lower ends and supplied with the powder;

a plurality of upper punches provided in those positions corresponding to the forming chambers on an upper surface side of the intermediate plate and slidable along an up/down direction;

a plurality of lower punches provided in those positions corresponding to the forming chambers on a lower surface side of the intermediate plate and slidable along the up/down direction;

upper holding means for holding the upper punches in upper raised positions out of the dies in a predetermined timing in accordance with a rotation of the main shaft;

powder feeding means for feeding the powder into the forming chambers when the upper punches are held by the upper holding means in the raised positions;

lower holding means for non-slidably holding the lower punches in lower positions and for preventing the lower punches from being removed from the lower ends of the forming chambers;

upper pressure applying means for downwardly pushing the upper punches into the forming chambers when the holding of the upper punches by the upper holding means in the raised positions is released in accordance with the rotation of the main shaft; and lower pressure applying means for, when the upper punches are downwardly pushed by the upper pressure applying means in accordance with the rotation of the main shaft, upwardly pushing the lower punches from the lower positions into the forming chambers in synchronization with the upper pressure applying means.

2. The apparatus according to claim 1, wherein the main shaft is formed as a hollow shaft with a support shaft inserted therein and upper and lower ends of the support shaft are fixed to upper and lower portions of the apparatus body.

3. The apparatus according to claim 1, wherein upper rams are provided in the apparatus body in positions above the intermediate plate such that the rams are slidable along the up/down direction, the upper rams having the upper punches respectively at lower ends and cam followers at the sides; and the upper holding means is comprised of a cam body rotated, together with the main shaft, as one unit and having cam faces with which the cam followers are engageable, the upper punches being slidable in the up/down direction in accordance with the rotation of the cam body by the engagement of the cam followers with the corresponding cam faces of the cam body.

4. The apparatus according to claim 1, wherein the powder feeding means comprises a hopper storing the powder, a feeder provided above the intermediate plate and slidable toward the forming chamber to allow the powder to be fed there from the hopper, and feeding drive means for, when the upper punch is held by the upper holding means in a raised position with the rotation of the main shaft, slidably moving the feeder to a covering position where the upper opening of the forming chamber is covered therewith.

5. The apparatus according to claim 4, wherein the feeding drive means comprises a feeding cam rotated integrally with the main shaft and an arm unit rotated by the rotation of the feeding cam to move the feeder in interlock therewith.

6. An apparatus for compression-forming powder into products, comprising:

an apparatus body;

a main shaft having an axis along an up/down direction of the apparatus body and rotatably supported on the apparatus body;

drive means for rotationally driving the main shaft;

an intermediate plate provided at an intermediate height of the apparatus body in a substantially horizontal state and having a plurality of dies arranged at predetermined intervals along a circumferential direction of the main shaft with a corresponding number of forming chambers opened at upper and lower ends and supplied with the powder;

a plurality of upper punches provided in those positions corresponding to the forming chambers on an upper surface side of the intermediate plate and slidable along the up/down direction;

a plurality of lower punches provided in those positions corresponding to the forming chambers on a lower surface side of the intermediate plate and slidable along the up/down direction;

upper holding means for holding the upper punches in upper raised positions out of the dies in a predetermined timing in accordance with a rotation of the main shaft;

powder feeding means for feeding the powder into the forming chambers when the upper punches are held by the upper holding means in the raised positions;

lower holding means for non-slidably holding the lower punches and for preventing the lower punches from being removed from the lower ends of the forming chambers;

upper back-up rolls arranged above the upper punches;

lower back-up rolls arranged below the lower punches;

an upper rotation plate provided integral with the main shaft, arranged between the upper punches and upper back-up rolls, and adapted to be rotated with the main shaft, the upper rotation plate having upper pressure applying members each adapted to be inserted between the upper punch and the upper back-up roll during the rotation of the upper rotation plate to allow the upper punch to be pushed downwardly; and a lower rotation plate provided integral with the main shaft, arranged between the lower punches and lower back-up rolls, and adapted to be rotated with the main shaft, the lower rotation plate having lower pressure applying members each adapted to be inserted between the lower punch and the lower back-up roll in synchronization with the upper pressure applying member during the operation of the main shaft to allow the lower punch to be pushed upwardly.

7. The apparatus according to claim 6, wherein the lower rotation plate has a push-out cam which, after the lower punches are pushed upwardly by the lower pressure applying members to cause the lower punches to be further raised, ejects compression-formed products from the corresponding forming chambers.

8. The apparatus according to claim 7, wherein pick-up means are provided near the forming chambers to enable the compression-formed products which are ejected from the forming chambers by the push-out cam of the lower rotation plate to be picked up.

9. The apparatus according to claim 6, wherein the intermediate plate has four dies arranged at 90°-angle intervals in the circumferential direction, the upper rotation plate has three upper pressure applying members arranged at 120°-angle intervals in the circumferential direction, and the lower rotation plate has three lower pressure applying members arranged at 120°-angle intervals in the circumferential direction and in positions corresponding to the upper pressure applying members.

10. The apparatus according to claim 6, wherein the compression-formed product is comprised of a lead wire-equipped slide brush for motors, and further comprising feeding means for feeding a lead wire into the forming chamber when the powder fed into the forming chamber is compression-formed and means for cutting the lead wire to a predetermined length when the compression-formed product is picked up.

11. The apparatus according to claim 10, wherein the feeding means is comprised of a clamper provided integral with the upper punch and adapted to hold the lead wire when the upper punch is lowered from the raised position and to enable the lead wire to be released from being held when the upper punch is raised from a lowered position.

* * * * *